US007837010B2

(12) United States Patent
Astor

(10) Patent No.: US 7,837,010 B2
(45) Date of Patent: Nov. 23, 2010

(54) COMBO BRACE RAIL SHIELD

(75) Inventor: Kyle G. Astor, Conneaut Lake, PA (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 10/946,743

(22) Filed: Sep. 21, 2004

(65) Prior Publication Data

US 2006/0060423 A1 Mar. 23, 2006

(51) Int. Cl.
*E06C 7/08* (2006.01)

(52) U.S. Cl. ..... 182/220; 182/217

(58) Field of Classification Search ..... 182/217–220
See application file for complete search history.

(56) References Cited

U.S. PATENT DOCUMENTS 4,415,062 A * 11/1983 Shaw ..... 182/109
5,458,463 A * 10/1995 Chiang ..... 416/210 R
5,791,439 A * 8/1998 Plotner et al. ..... 182/219
6,408,984 B1 * 6/2002 Cavagnaro ..... 182/205
6,779,632 B1 * 8/2004 Parks, III ..... 182/204

* cited by examiner

*Primary Examiner*—Alvin C Chin-Shue
(74) *Attorney, Agent, or Firm*—Ansel M. Schwartz

(57) ABSTRACT

A brace rail shield combination for a rail of a ladder having at least one rung having a first portion that has a shape that conforms with an interior cross sectional surface of the rail. The brace rail shield combination includes a second portion that extends from the first portion at a first location to the rung to provide structural support to the rung. The second portion having an attachment portion at a second location spaced apart from the first location that is fixed to the rung. The first portion and the second portion being one continuous piece. A method for using an extension ladder. A method for producing a knee brace rail shield combination.

8 Claims, 8 Drawing Sheets

COMBO BRACE RAIL SHIELD

FIELD OF THE INVENTION

The present invention is related to a brace rail shield combination that is one continuous piece. More specifically, the present invention is related to a brace rail shield combination that is one continuous piece which has a metal plate and holds a safety shoe.

BACKGROUND OF THE INVENTION

The current extension ladder knee brace is shown in FIG. 7. It consists of six rivets, one plastic brace, and one extruded aluminum rail shield. The assembly is riveted through the shield, fiberglass rail, and plastic brace. The top of the brace is riveted to the bottom rung of the extension ladder. When the ladder is being used, the load goes through the rail and rivets and is transferred into the plastic brace and aluminum rail shield. The bottom edge of the aluminum rail shield transfers the load into the safety shoe.

SUMMARY OF THE INVENTION

The present invention pertains to a brace rail shield combination for a rail of a ladder having at least one rung. The brace rail shield combination comprises a first portion that has a shape that conforms with an interior cross sectional surface of the rail. The brace rail shield combination comprises a second portion that extends from the first portion at a first location to the rung to provide structural support to the rung. The second portion having an attachment portion at a second location spaced apart from the first location that is fixed to the rung. The first portion and the second portion being one continuous piece.

The present invention pertains to a method for using an extension ladder. The method comprises the steps of moving the extension ladder to a structure. There is the step of leaning the extension ladder against the structure so weight on a ladder is distributed to the knee brace rail shield combination connected to a bottom of each rail of the ladder. The knee brace rail shield combination comprising a first portion that has a shape that conforms with an interior cross sectional surface of the rail; and a second portion that extends from the first portion at a first location to the rung to provide structural support to the rung. The second portion having an attachment portion at a second location spaced apart from the first location that is fixed to the rung. The first portion and the second portion being one continuous piece.

The present invention pertains to a method for producing a knee brace rail shield combination. The method comprises the steps of placing a metal plate into a mold of the knee brace rail shield combination. There is the step of injection molding plastic into the mold to form the knee brace rail shield combination comprising a first portion that has a shape that conforms with an interior cross sectional surface of the rail; and a second portion that extends from the first portion at a first location to the rung to provide structural support to the rung. The second portion having an attachment portion at a second location spaced apart from the first location that is fixed to the rung. The first portion and the second portion being one continuous piece with the metal plate embedded in the second portion.

BRIEF DESCRIPTION OF THE DRAWINGS

In the accompanying drawings, the preferred embodiment of the invention and preferred methods of practicing the invention are illustrated in which.

DETAILED DESCRIPTION

Figure 2:
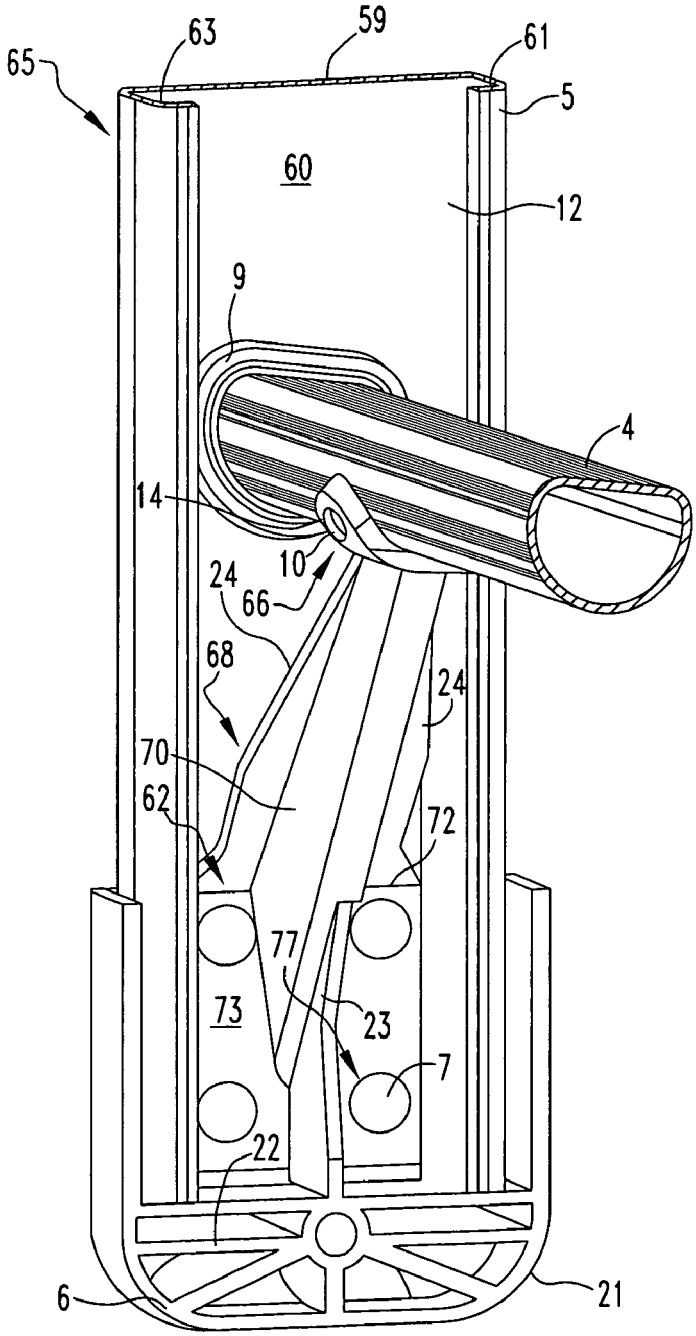
FIG. 2 is a perspective inside view of the brace rail shield combination in place in a rail of a ladder.
Figure 3:
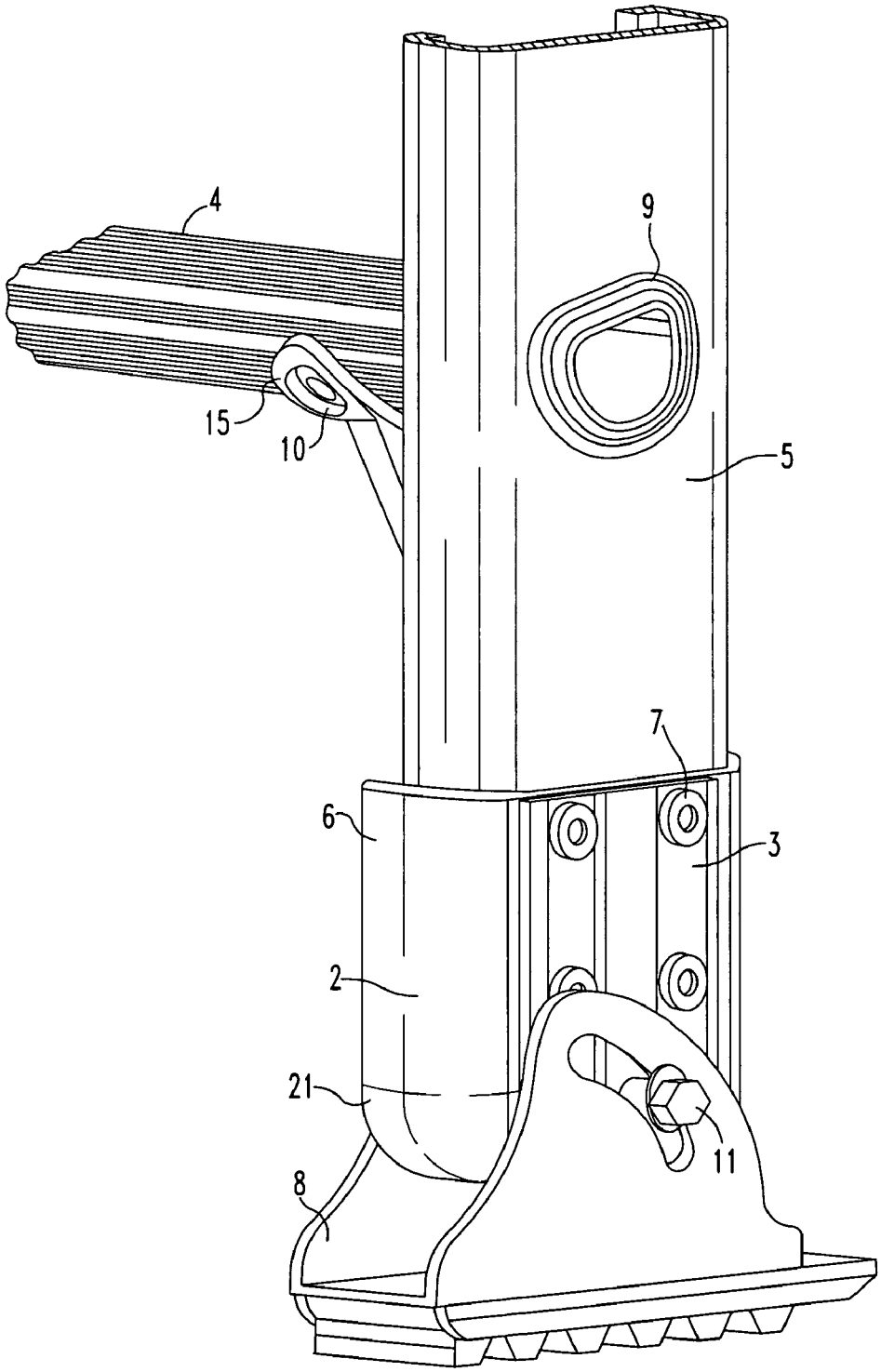
FIG. 3 is a perspective outside view of the brace rail shield combination in place with a rail of the ladder.
Figure 4A:
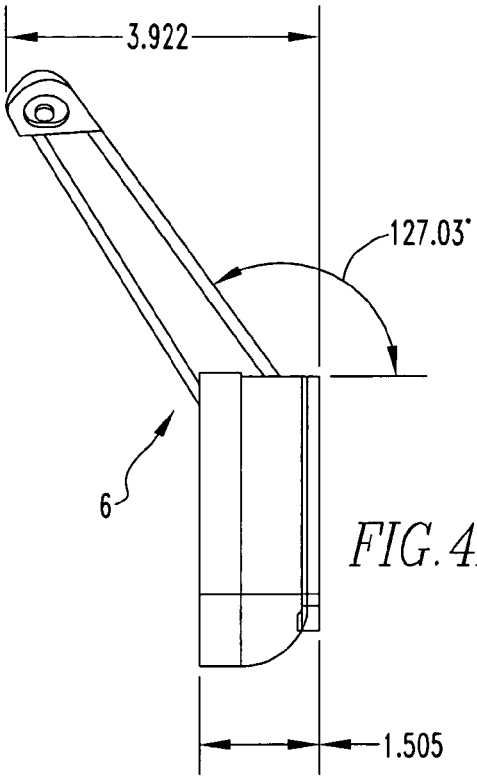
FIG. 4*a* is a side view of the brace rail shield combination.
Figure 4C:
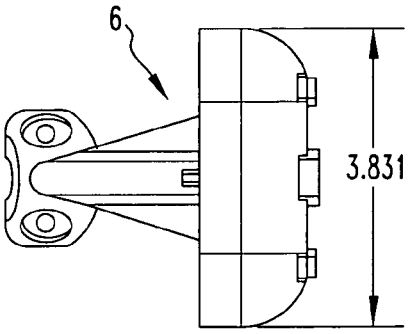
FIG. 4*c* is a bottom view of the brace rail shield combination.
Figure 4B:
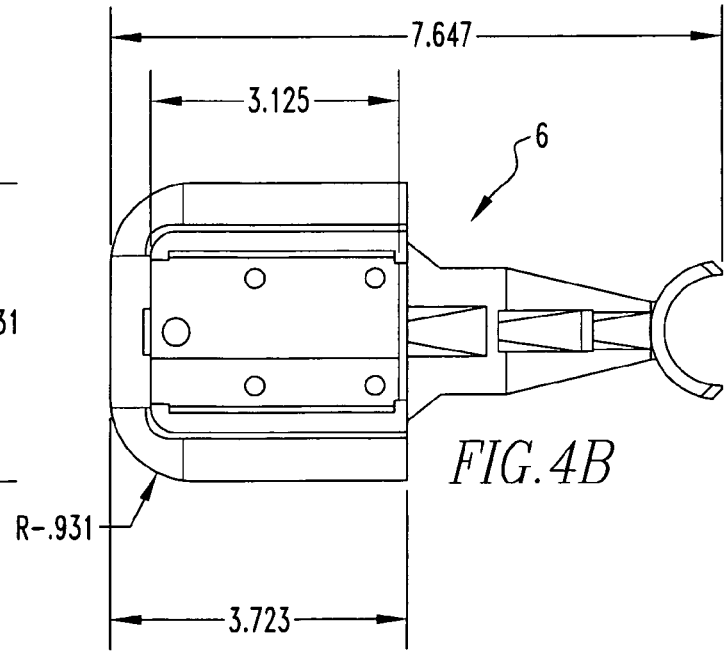
FIG. 4*b* is an overhead view of the brace rail shield combination.
Figure 5:
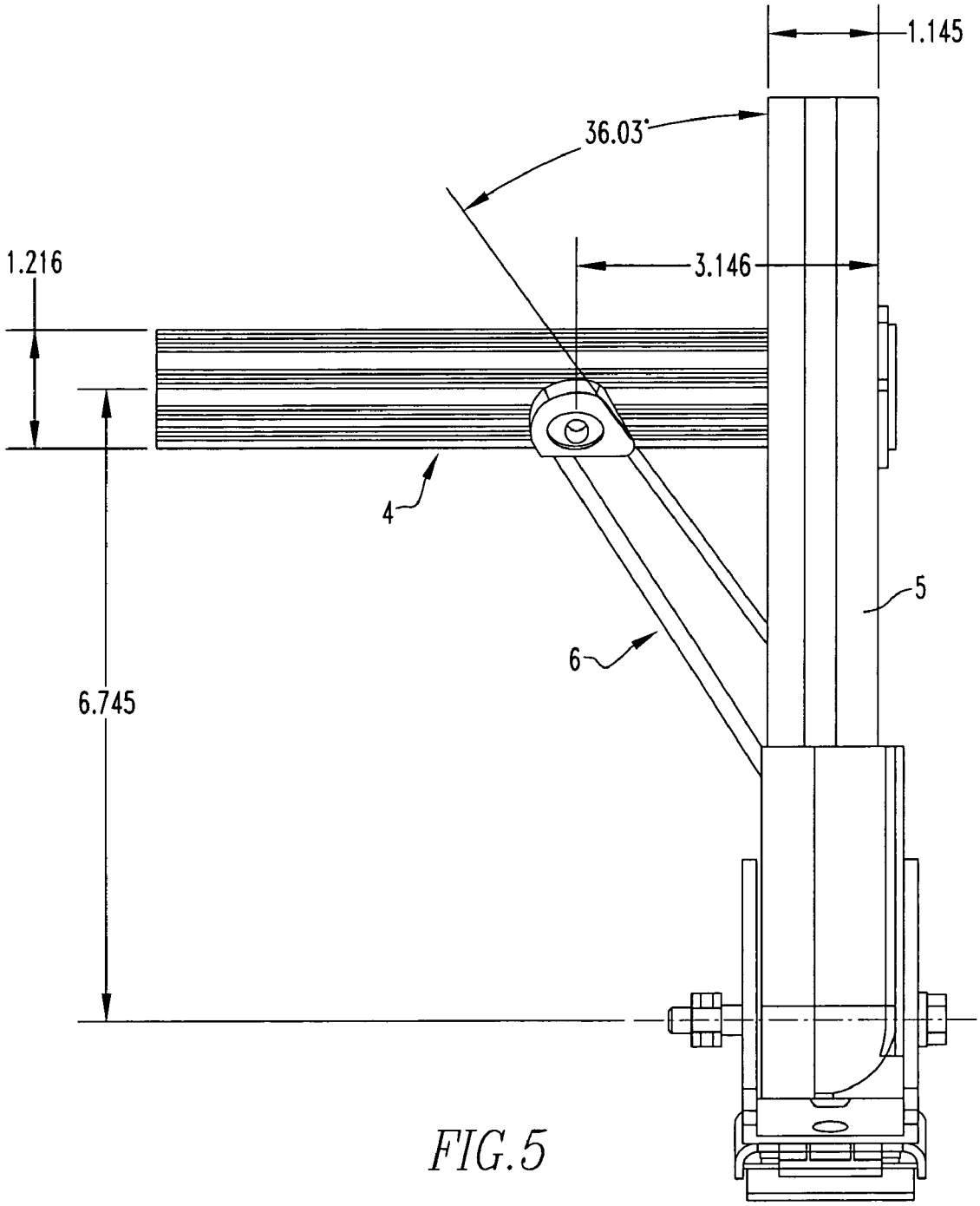
FIG. 5 is a front view of the portion of the ladder with the brace rail shield combination.
Figure 6:
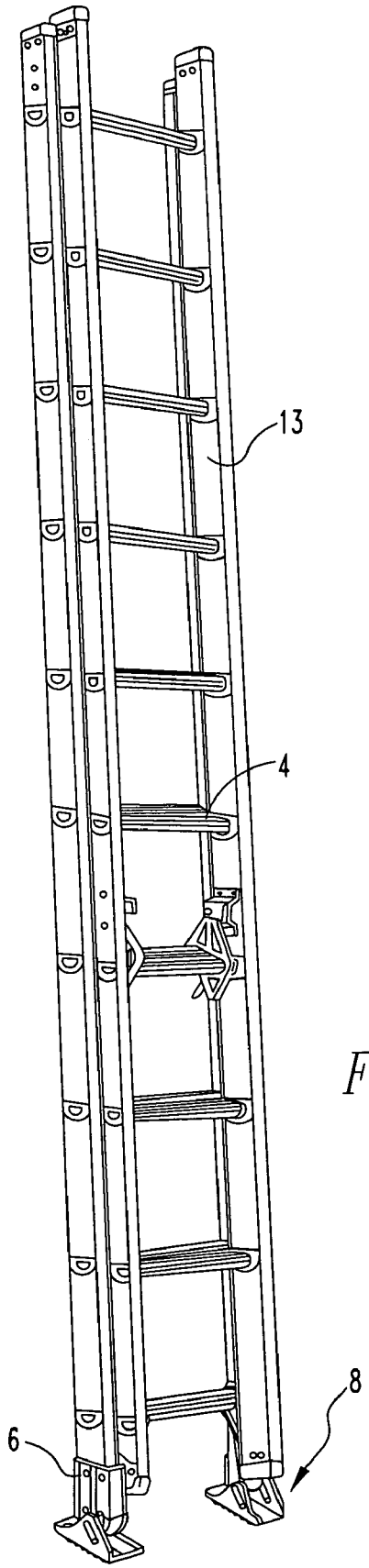
FIG. 6 is a perspective view of an extension ladder having the brace rail shield combination.
Figure 7:
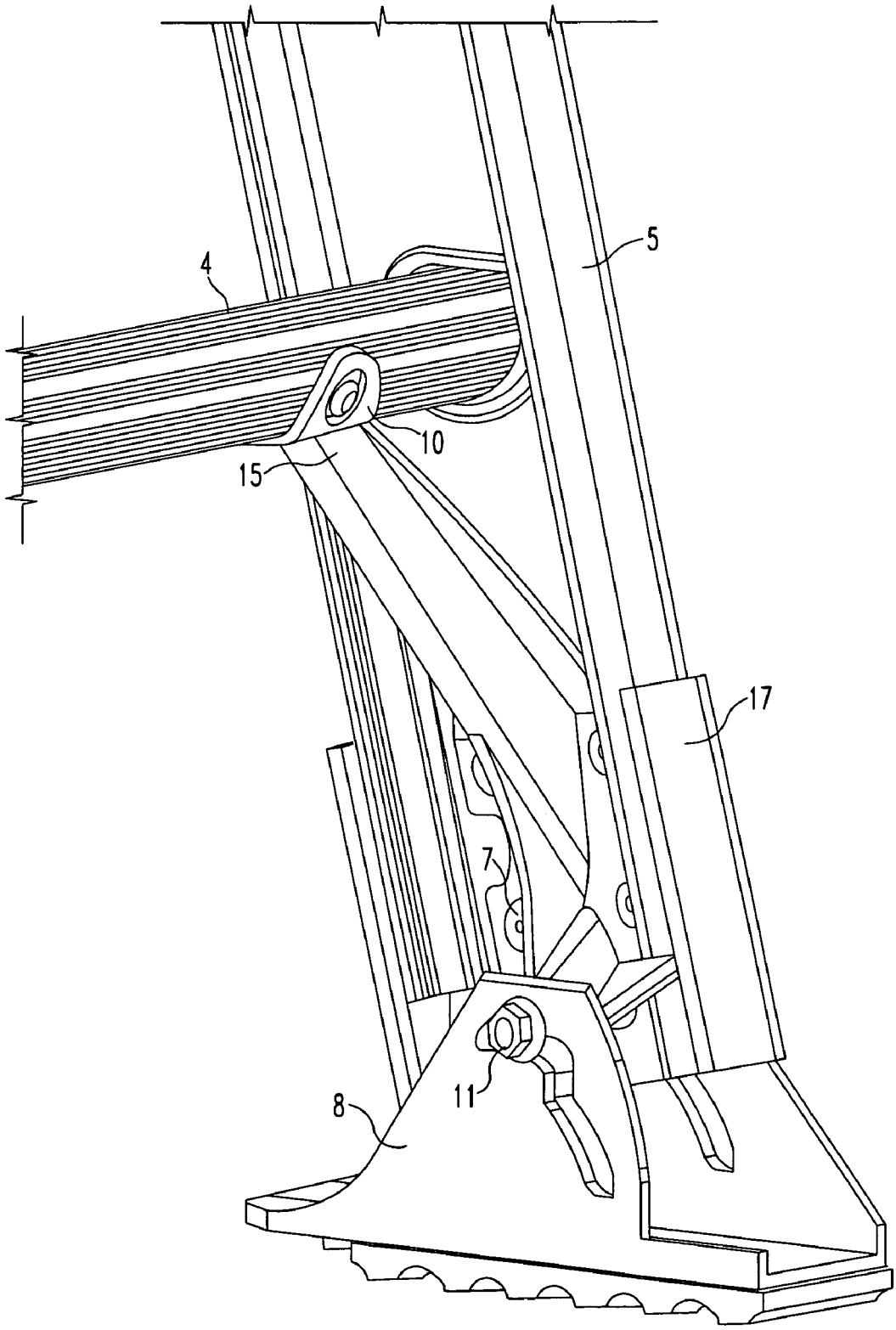
FIG. 7 PRIOR ART
FIG. 7 is a perspective view of a prior art knee brace and rail shield on a ladder rail.

Referring now to the drawings wherein like reference numerals refer to similar or identical parts throughout the several views, and more specifically to FIGS. 2, 3 and 6 thereof, there is shown a brace rail shield combination 6 for a rail 5 having a web 59, a first flange 61 and a second flange 63 of a ladder 13 having at least one rung 4. The brace rail shield combination 6 comprises a first portion 56 that has a shape that conforms with an interior cross sectional surface 60 of the rail 5 and an exterior surface 65 of the rail 5. The brace rail shield combination 6 comprises a second portion 58 that extends from the first portion 56 at a first location 62 to the rung 4 to provide structural support to the rung 4. The second portion 58 having an attachment portion 64 at a second location 66 spaced apart from the first location 62 that is fixed to the rung 4. The first portion 56 and the second portion 58 being one continuous piece.

Preferably, the brace rail shield combination 6 includes a metal plate 3 in the first portion 56. The metal plate 3 can be embedded or inserted into the first portion 56. The first portion 56 and second portion 58 are preferably made of plastic. Preferably, the second portion 58 forms an angle of between 5 and 85 degrees with the first portion 56. The second portion 58 preferably has a first face 68 which resists twisting that extends from a top edge 72 of the first portion 56, and a second face 70 extending perpendicularly from the first face 68 along the first face 68 and from the first portion 56.

Preferably, the second portion 58 includes a buttress 23 that extends from the second face 70 and the first portion 56. The first portion 56 preferably has a shoulder bolt hole 74 for a shoulder bolt 11 to hold a safety shoe 8 to the first portion 56. Preferably, the first portion 56 has ribs along the bottom of the first portion 56 to absorb forces while the ladder 13 is in use.

The present invention pertains to a method for using an extension ladder 13. The method comprises the steps of moving the extension ladder 13 to a structure. There is the step of leaning the extension ladder 13 against the structure so weight on a ladder 13 is distributed to the knee brace rail shield combination 6 connected to a bottom of each rail 5 of the ladder 13. The knee brace rail shield combination 6 comprising a first portion 56 that has a shape that conforms with an interior cross sectional surface 60 of the rail 5; and a second portion 58 that extends from the first portion 56 at a first location 62 to the rung 4 to provide structural support to the rung 4. The second portion 58 having an attachment portion 64 at a second location 66 spaced apart from the first location 62 that is fixed to the rung 4. The first portion 56 and the second portion 58 being one continuous piece.

The present invention pertains to a method for producing a knee brace rail shield combination 6. The method comprises the steps of placing a metal plate 3 into a mold of the knee brace rail shield combination 6. There is the step of injection molding plastic into the mold to form the knee brace rail shield combination 6 comprising a first portion 56 that has a shape that conforms with an interior cross sectional surface 60 of the rail 5; and a second portion 58 that extends from the first portion 56 at a first location 62 to the rung 4 to provide structural support to the rung 4. The second portion 58 having an attachment portion 64 at a second location 66 spaced apart from the first location 62 that is fixed to the rung 4. The first portion 56 and the second portion 58 being one continuous piece with the metal plate 3 embedded in the second portion 58.

Figure 1A:
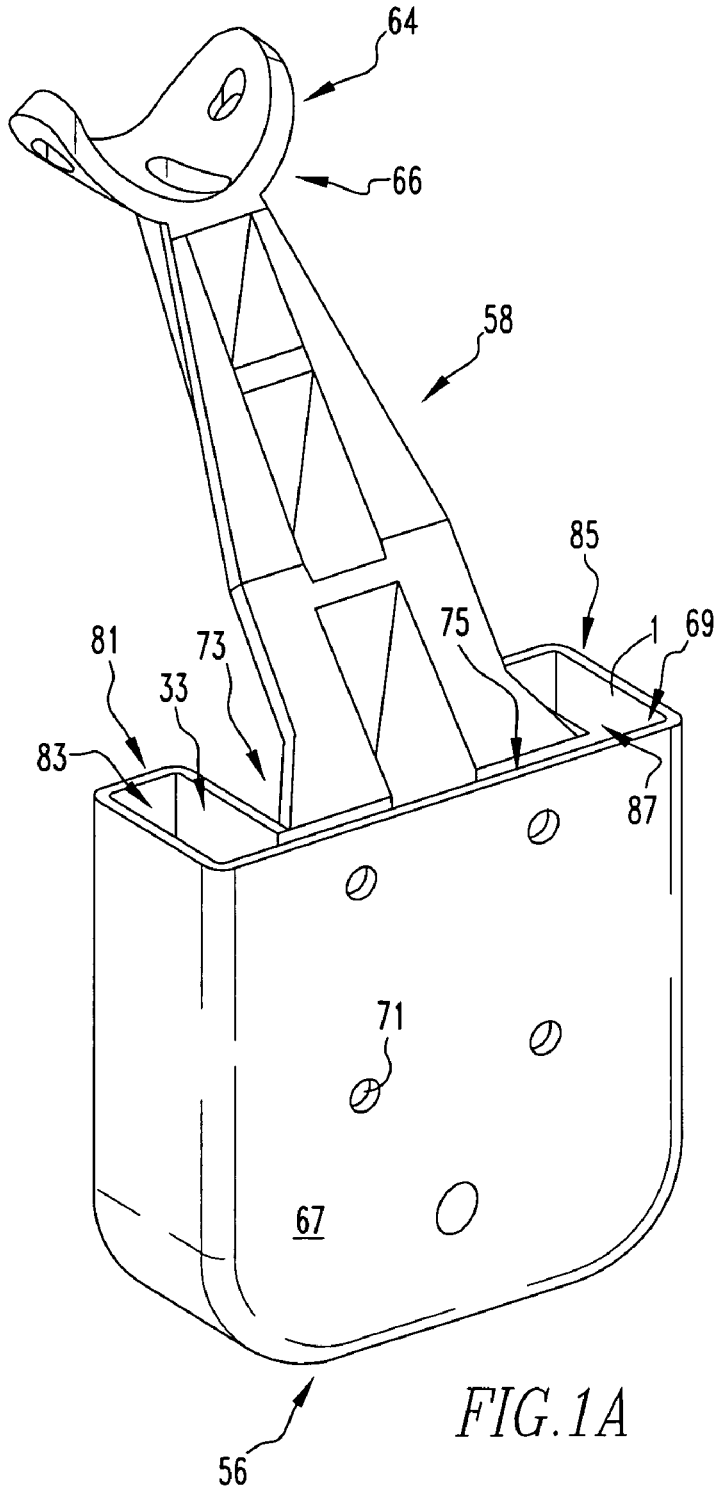
FIG. 1*a* is a perspective view of the first embodiment of a brace rail shield combination of the present invention.
Figure 1B:
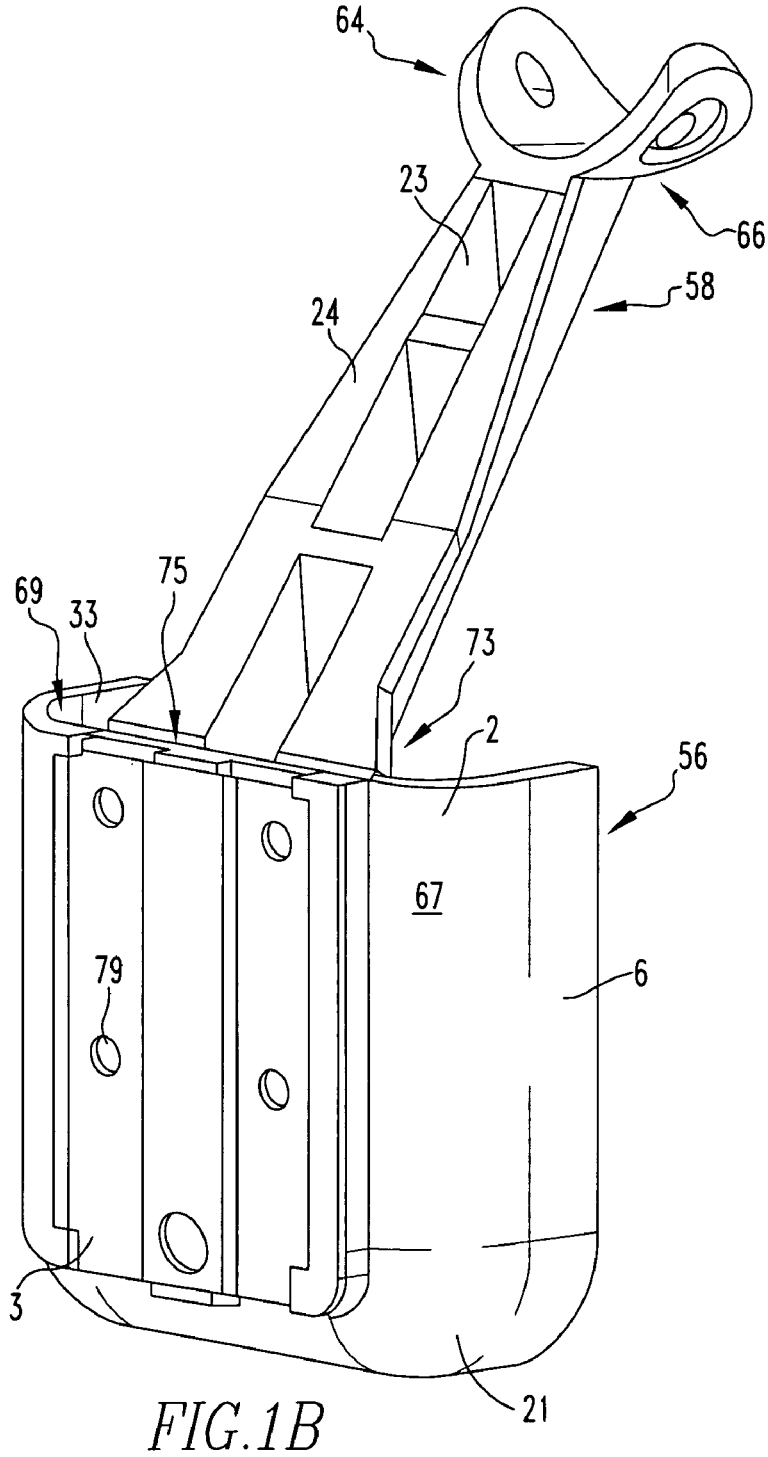
FIG. 1*b* is a perspective view of a second embodiment of the brace rail shield combination of the present invention.

In the operation of the invention, the brace rail shield combination 6, as shown in FIG. 1, is a plastic part 2 (which is formed from the first portion 56 and the second portion 58) with a metal plate 3. The plastic part 2 includes a knee brace (second portion 58) and cover (first portion 56) to protect the fiberglass rail 5. The brace rail shield combination 6 is used on extension ladders 13 of various heights. The one piece plastic part 2 with plate 3 forms a tight fit on the bottom end of the stationary (base) section of the extension ladder 13, with the rail 5 fitting into the slot 33 of the brace rail shield combination 6. The slot 33 has a cross-sectional shape of essentially a C, the first portion 56 having an outer side 67 that has an inner surface 69 which is essentially flat and conforms with and contacts the rail web's 59 outer surface and the first flange's 61 outer surface and the second flange's 63 outer surface and at least one hole 71, and an inner side 73 that has an inner surface 75 which is essentially flat and conforms with and contacts the rail web's inner surface and has at least one hole 77 which aligns with the one hole 71 of the outer side 67, the metal plate 3 having at least one hole 79 which aligns with the one hole of the inner side 73 and the outer side 67, the rivet 7 extending through the one hole of the outer side and the inner side and the metal plate and the rail web 59 to fix the first portion 56 to the rail 5. As shown in the embodiment of FIG. 1*a*, there is a first flange portion 81 attached to and extending from the outer side and the inner side and defining an opening 83 that has an essentially cross-sectional rectangular shape that conforms with the first flange's cross-section and which contacts the first flange's outer surface and inner surface, and a second flange portion 85 attached to and extending from the outer side and the inner side and defining an opening 87 that has an essentially cross-sectional rectangular shape that conforms with the second flange's cross-section and which contacts the second flange's outer surface and inner surface.

The purpose of the brace rail shield combination 6 is to speed up the assembly process and eliminate unnecessary components. The one piece plastic part 2, with metal plate 3 eliminates the need for the current plastic knee brace 15 and separate aluminum rail shield 17. FIG. 6 shows the brace rail shield combination 6, attached to the bottom of extension ladder 13. The elimination of the heavy aluminum rail shield 17 lightens the ladder 13 and allows for easy aesthetic changes via the molding of the plastic part 2.

The main component of the brace rail shield combination 6 is the molded plastic part 2. Attached to this part is a metal backup plate 3. The back up plate 3 adds a surface to upset rivets 7, abrasion resistance, and extra support to the plastic part 2. The plastic material must have high impact strength, good abrasion resistance, and be nonconductive. The material chosen is a high impact polypropylene. A variety of other materials will accomplish the strength requirements, such as Nylon, filled polymers, and co-polymers.

FIG. 1 shows the plastic part 2 assembled with the metal backup plate 3, to complete the brace rail shield combination 6. An alternate design of the brace rail shield combination 6, allows multiple rail 5 profiles to be used. The metal backup plate 3 is pre-assembled by the injection molder to speed up the assembly process. The back up plate 3 consists of four holes used for riveting the brace rail shield combination 6 to the base rail 5, and one larger hole for the shoulder bolt 11 to assemble the safety shoe 8.

FIG. 2 shows the 6 on the bottom of the base section 5 of a FRP extension ladder 13. The four semi-tubular rivets 7 are placed through the brace rail shield combination 6 and base FRP side rail 5 with the rivet's heads on the side opposite of the backup plate 3. The two pop rivets 10 are then set, with washers 14 through the top of the brace rail shield combination 6 and into the bottom rung 4.

FIG. 3 shows the assembled backup plate 3, plastic part 2, and safety shoe 8 riveted on to the base section 12 of the FRP extension ladder 13. The safety shoe 8 can either be assembled prior to or during final assembly of the extension ladder 13.

When the ladder 13 is in the ANSI required 75.5 degree incline position, the brace rail shield combination 6 is resting with the rounded bottom 21 in contact with the shoe 8. The applied load to the ladder 13 is between 800 and 1200 lb depending on the duty rating of the ladder 13. The resultant downward load is placed on the ladder 13 so that the force goes through the four rivets 7 and is dispersed through the bottom of the brace rail shield combination 6 at the rounds 21. The brace rail shield combination 6 is designed to distribute the downward load evenly with minimal stress concentrations. This is aided by the integration of the plastic rail 5 shield and brace for added strength. When dropped on its side from a given height, the sideways force on the brace rail shield combination 6 is absorbed by the plastic part 2 and not by the side rail 5. The brace rail shield combination 6 will withstand breaking when dropped repeatedly to simulate use in the field.

The brace rail shield combination 6 is designed with thick ribs 22 located near the rounds 21 at the bottom. The ribs 22 on the brace rail shield combination 6 absorb forces applied while the ladder 13 is in use and impact forces if the ladder 13 is dropped. The brace rail shield combination 6 also resists twisting of 5 through the utilization of the strong plastic cross ribs 22 FIG. 2. The buttress 23 at the top of the brace rail shield combination 6 is designed to attach to the rung 4 and then direct the forces applied to rung 4 through the four rivets 7 and the bottom of the brace rail shield combination 6. The forces applied to the rung 4 are then distributed through the brace rail shield combination 6 instead of through the rung-to-rail connection 9. The top of the brace rail shield combination 6 is designed with wings 24 on either side to resist twisting of rail 5 and add over all strength.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A brace rail shield combination for a rail having a web, a first flange and a second flange of a ladder having at least one rung and one rivet comprising:

a first portion that has a shape that conforms with an interior cross sectional surface of the rail and an exterior cross-sectional surface of the rail, a rounded bottom, and a metal plate in the first portion, and which extends about the rail's exterior to cover the rail and protect the rail, the first portion having a slot which receives the bottom of the rail so the first portion fits around the bottom of the rail, the slot having a cross-sectional shape of essentially a C, the first portion having an outer side that has an inner surface which is essentially flat and conforms with and contacts the rail web's outer surface and the first flanges 61 outer surface and the second flange's 63 outer surface and at least one hole, and an inner side that has an inner surface which is essentially flat and conforms with and contacts the rail web's inner surface and has at least one hole which aligns with the one hole of the outer side, the metal plate having at least one hole 79 which aligns with the one hole of the inner side 73 and outer side 67, the rivet extending through the one hole of the outer side and the inner side and the metal plate and the rail web to fix the first portion to the rail;

a second portion that extends from the first portion at a first location to the rung to provide structural support to the rung, the second portion having an attachment portion at a second location spaced apart from the first location that is fixed to the rung, the first portion and the second portion being one continuous piece of plastic; and a safety shoe connected to the first portion.

2. A brace rail shield combination as described in claim 1 wherein the first portion and second portion are made of plastic.

3. A brace rail shield combination as described in claim 2 wherein the second portion forms an angle of between 5 and 85 degrees with the first portion.

4. A brace rail shield combination as described in claim 3 wherein the second portion has a first face which resists twisting that extends from a top edge of the first portion, and a second face extending perpendicularly from the first face along the first face and from the first portion.

5. A brace rail shield combination as described in claim 4 wherein the second portion includes a buttress that extends from the second face and the first portion.

6. A brace rail shield combination as described in claim 5 wherein the first portion has a shoulder bolt hole for a shoulder bolt to hold the safety shoe to the first portion.

7. A brace rail shield combination as described in claim 6 wherein the first portion has ribs along the bottom of the first portion to absorb forces while the ladder is in use.

8. A brace rail shield as described in claim 7 wherein the first portion includes a first flange portion attached to and extending from the outer side and the inner side and defining an opening that has an essentially cross-sectional rectangular shape that conforms with the first flange's cross-section and which contacts the first flange's outer surface and inner surface, and a second flange portion attached to and extending from the outer side and the inner side and defining an opening that has an essentially cross-sectional rectangular shape that conforms with the second flange's cross-section and which contacts the second flange's outer surface and inner surface.

* * * * *